US010797437B2

(12) United States Patent
Hale et al.

(10) Patent No.: US 10,797,437 B2
(45) Date of Patent: Oct. 6, 2020

(54) LIGHT SOCKET WITH EXTERNAL CONFIGURATION FOR AN ATTACHMENT

(71) Applicant: Wintergreen Corporation, Alpharetta, GA (US)

(72) Inventors: William Hale, Cumming, GA (US); Frank Skinner, Woodstock, GA (US)

(73) Assignee: Wintergreen Corp., Alpharetta, GA (US)

( * ) Notice: Subject to any disclaimer, the term of this patent is extended or adjusted under 35 U.S.C. 154(b) by 0 days.

(21) Appl. No.: 16/684,031

(22) Filed: Nov. 14, 2019

(65) Prior Publication Data

US 2020/0161804 A1 May 21, 2020

Related U.S. Application Data

(60) Provisional application No. 62/767,976, filed on Nov. 15, 2018.

(51) Int. Cl.

| | |
|---|---|
| ***H01K 1/00*** | (2006.01) |
| ***H01R 13/629*** | (2006.01) |
| ***H01R 33/22*** | (2006.01) |

(52) U.S. Cl.

CPC ..... *H01R 13/629* (2013.01); *H01R 33/22* (2013.01)

(58) Field of Classification Search

CPC .... H01R 33/09; H01R 13/26; H01R 13/5216; H01R 13/521

USPC ..... 439/617, 918, 699.2, 276, 936

See application file for complete search history.

(56) References Cited

U.S. PATENT DOCUMENTS

| | | | | |
|---|---|---|---|---|
| 7,025,612 | B1 * | 4/2006 | Keilholz | H01R 33/22 429/230 |
| 7,306,488 | B2 * | 12/2007 | Krijne | H01R 33/06 439/617 |
| 9,605,811 | B2 * | 3/2017 | Wang | F21V 23/005 |
| 9,841,148 | B1 * | 12/2017 | Wang | F21V 29/70 |
| 10,100,983 | B2 * | 10/2018 | Wang | F21V 29/70 |
| 10,655,796 | B2 * | 5/2020 | Wang | F21K 9/238 |

* cited by examiner

*Primary Examiner* — Phuong Chi Thi Nguyen

(74) *Attorney, Agent, or Firm* — Rachel H. Huffstetler; FisherBroyles, LLP

(57) ABSTRACT

A socket for receipt of a light bulb to connect the light bulb to a power source wherein the socket has an external configuration adjacent the socket opening configured to cooperate with an attachment such as a cap or decorative element. The socket further includes an external configuration along its outer side surface and/or its bottom surface configured to cooperate with an attachment such as a mounting clip or stake.

21 Claims, 3 Drawing Sheets

LIGHT SOCKET WITH EXTERNAL CONFIGURATION FOR AN ATTACHMENT

CROSS REFERENCE TO RELATED APPLICATION

This application claims priority to and the benefit of U.S. Prov. Patent Application Ser. No. 62/767,976 filed Nov. 15, 2018, the disclosure of which is hereby incorporated by reference.

FIELD OF THE INVENTION

The present invention is generally directed to a socket for receipt of a light bulb to connect the light bulb to a power source. More specifically, the socket includes an external configuration adjacent the socket opening configured to cooperate with an attachment such as a cap or decorative element. The socket further includes an external configuration along its outer side surface and/or its bottom surface configured to cooperate with an attachment such as a mounting clip or stake.

BACKGROUND OF THE INVENTION

A conventional socket is intended to secure a light bulb into the socket of the lighting fixture (light strand or other fixture) and to conduct electric current through a positive terminal and a ground terminal of the bulb to achieve illumination. For example, a socket is often connected to a light strand with numerous other sockets to form a lighted strand of lights, such as for decorative purposes. Such exemplary strands are intended for indoor or outdoor use and often it is desirable to not utilize every socket on the strand to achieve the desired decorative effect. Often, individual sockets are taped to close the socket when it is not desired to illuminate that socket on the strand and to keep water and moisture out, such as for outdoor use. Additionally, light strands are more versatile if attachments, such as decorative attachments, are secured to the socket so that the light source housed therein illuminates the decorative attachment.

Moreover, individual sockets, either on a light strand or provided singularly, are supported by supportive attachments such as a clip or stake. By way of example, clips are often used to secure light strands to architectural structures, such as house gutter. Another example is a stake which supports an individual light, lighted structure, or light strand.

SUMMARY OF THE INVENTION

It is, therefore, advantageous for a light socket to be configured to cooperate with a light attachment such as a cap or a decorative attachment. It is also advantageous for a light socket to be readily secured to a supportive attachment such as a clip or stake.

The present invention overcomes shortcomings of the prior art by providing a novel light socket configuration having an outer configuration adjacent the socket opening for receipt of the light bulb. Additionally, the novel light socket includes a novel side and/or bottom configuration for cooperating with a supportive member. These and other objectives are met by the present invention.

DETAILED DESCRIPTION OF THE INVENTION

Figure 1:
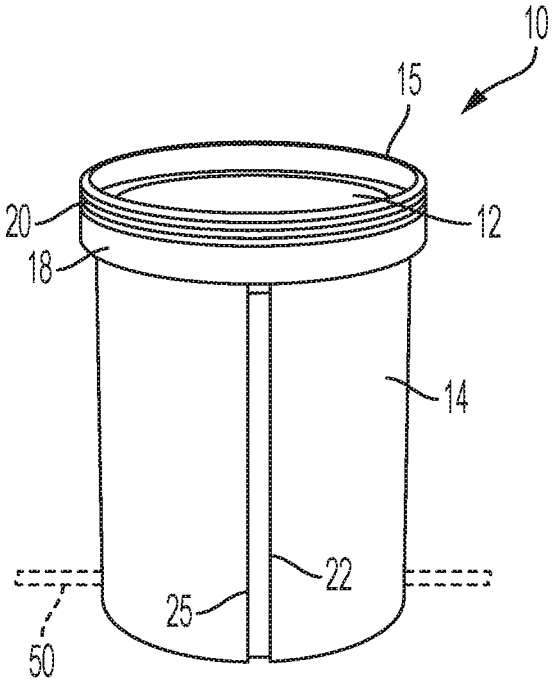
FIG. 1 is a perspective view of the socket according to an aspect of the present invention.

The present invention will now be described in detail hereinafter by reference to the accompanying drawings. The invention is not intended to be limited to the embodiments described; rather, this detailed description is provided to enable any person skilled in the art to make and practice the invention.

As used herein, the terms "proximal" and "distal" (excluding horizontal cross-sections) are used to refer to the axial ends of the socket and various components. The term "proximal end" refers to the end closely adjacent the socket opening for receipt of the bulb and the term "distal end" refers to the end of the socket for connecting to a wire. Also, as used herein, the "radial direction" refers to a direction which intersects the longitudinal axis, at any angle.

As shown in the Figures, the socket 10 is generally cylindrical with a hollow, bulb receiving cavity 12 defined therein. The socket 10 includes a generally cylindrical portion or sidewall 14 and a proximal open end 15 configured for receipt of a bulb and distal or bottom surface 16 for connecting to the power source. The socket 10 may be of any geometric configuration, including having a non-symmetric profile. The socket 10, as shown, includes a circumferentially extending flange 18 adjacent the proximal open end 15. As shown, flange 18 extends radially outwardly from the sidewall 14, but it may be recessed from the sidewall 14 or flush therewith. The flange 18 includes a mating member 20 which, as shown, is defined by a threaded portion. Other mating members 20 may be employed, such as a friction-fit configuration, magnetically attractive material, or other connection. The mating member 20 is configured to cooperate with a light attachment, not shown, such as a cap or decorative element.

Figure 3:
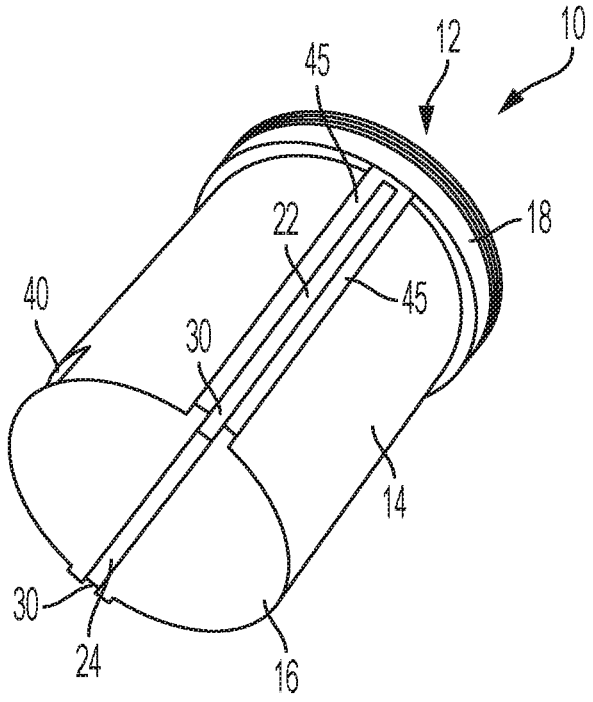
FIG. 3 is a bottom perspective view thereof.

As shown in FIGS. 1 and 3, particularly, adjacent sockets may be electrically connected by an electronically conductive cord such as cord 50 shown in phantom in FIG. 1. Cord 50 may extend through apertures 40 on opposing sides of the sidewall 14 as shown in FIG. 3. The distal and surface 16 is coupled to the sidewall 14 or may be integrally formed therewith. It is within the scope of the present invention to connect adjacent sockets directly, without a cord, such as in a cluster formation wherein the sockets are connected to one another.

Figure 2:
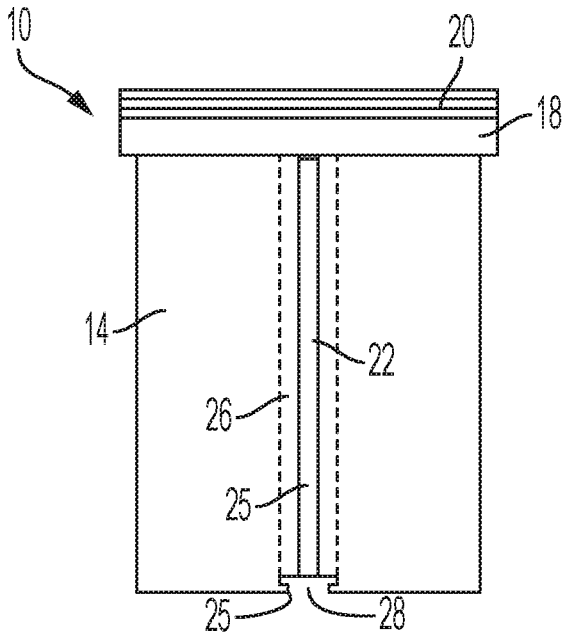
FIG. 2 is a side elevational, schematic view thereof.

FIGS. 1-3 illustrate a socket 10 according to one aspect of the present invention including a sidewall mating member 22 and a distal mating member 24. The sidewall mating member 22, as shown, extends longitudinally from the proximal flange 18, along the sidewall 14, and to the distal surface 16. It is within the scope of the present invention that the sidewall mating member extends to the proximal open end 15 or that it extends a shorter distance along the sidewall 14 such as not extending to the proximal flange 18 and/or the distal surface 16. As shown, the distal mating member 24 extends between opposing sidewall edges and is positioned centrally on the distal surface 16. It is within the scope of the present invention, however, that it not extend substantially across the distal surface 18 and/or extends along a distance thereof which does not intersect the center thereof. As shown, the sidewall mating member 22 and distal mating member 24 are positioned on the socket 10 such that the mating members are aligned and extend co-linearly. The mating members may be positioned wherein they do not align and are not co-linear.

As shown in FIGS. 1-2, the mating member 22 and a distal mating member 24 are defined by the sidewall 14 and distal surface 16, respectively, as recessed mating members 22, 24. The sidewall mating member 22 extends radially inwardly from the outer surface of the sidewall 14. The sidewall 14 has a predetermined thickness for defining the sidewall mating member 22. The recessed sidewall mating member 22 is generally T-shaped as best shown schematically in FIG. 2. The mating member 22 is defined by a longitudinally extending exterior channel 25 having a first width and a longitudinally extending interior channel 26 having a second width greater than the exterior channel 25 first width. The mating member 22 includes an open distal end 28, by way of example. It is within the scope of the present invention to provide an open proximal end or an intermediate opening along the length of the mating member 22. The open distal end 28 as shown is configured for receipt of an attachment, such as a supportive attachment, which may be received by the mating member 22 and the attachment is slideable along the length of at least a portion of the sidewall mating member 22. It is within the scope of the present invention to provide an open proximal end to the sidewall mating member 22 rather than or in addition to the open distal end 28. The sidewall mating member 22 shown in FIG. 3 illustrates that the mating member 22 may not be substantially flush with the sidewall 14. Particularly if the sidewall 14 thickness is not sufficiently thick to define the mating member 22, the mating member 22 may extend radially outwardly from the sidewall 14 as exemplified in FIG. 3. As shown, a pair of flanges 45 extend outwardly from the sidewall 14 and define at least the longitudinally extending interior channel 26 and may also define the longitudinally extending interior channel 26. However, the sidewall 14 may selectively define the interior channel 26.

The distal mating member 24 as shown in FIGS. 1-3 are similarly configured as the sidewall mating member 22 and includes an exterior channel 25 and interior channel 26 having the previously described widths for defining a T-shaped mating member. As shown, the distal mating member 24 defines open side ends 30. It is within the scope of the present invention, however, that the distal mating member 24 include only one open channel end 30 and that open channel end 30 may be positioned adjacent the sidewall 14 at any location along the circumference or along the distal surface 18 remote from the circumferential edge.

The distal surface 16 may be integrally formed with the sidewall 14 or may be separately formed and connected with the sidewall 14. The sidewall 14 also includes a pair of opposing apertures 40 configured for receipt of an electrically conducting cord 50 shown in phantom in FIG. 2. The cord 50 provides power to the socket 10 and may connect adjacent sockets 10 if more than one are provided in an electrical circuit.

Accordingly, the mating members 22, 24 may receive and cooperate with supporting attachments. For example, if the socket 10 is on a light strand, a standard gutter clip may be provided wherein the sidewall mating member 22 or distal end surface 24 may cooperate with the clip which is received within the open distal end 28 or side end 30 and be received within the respective interior channel 26. Another exemplary use is for supporting the socket 10 on a stake wherein the stake may cooperate with mating member 22 or 24. When the socket 10 is provided with both a sidewall mating member 22 and distal mating member 24, the socket may selectively be supported to direct illumination in different directions, such as vertically or horizontally. Of course, only one may be provided without departing from the scope of the present invention.

Figure 4:
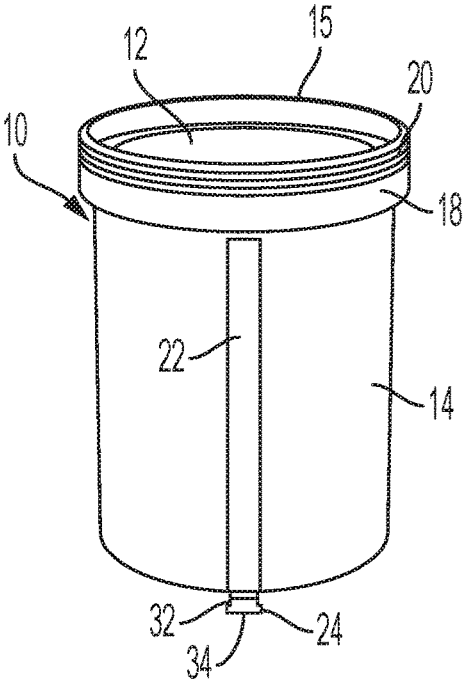
FIG. 4 is a perspective view of the socket according to another aspect of the present invention.
Figure 5A:
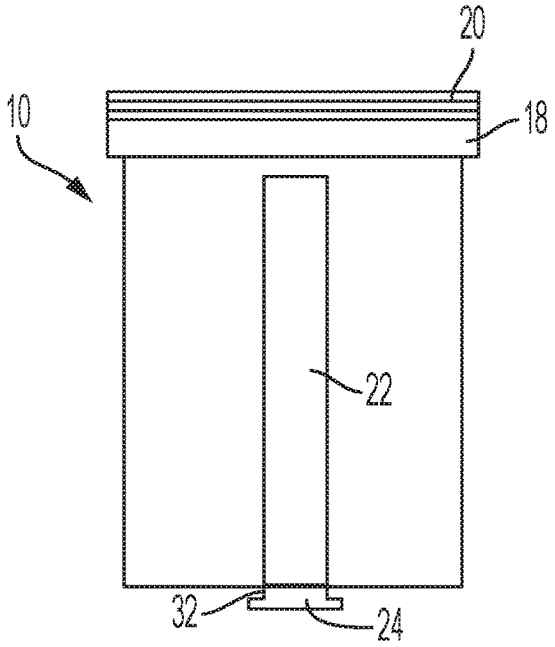
FIGS. 5A and 5B are side elevational, schematic views thereof.
Figure 5B:
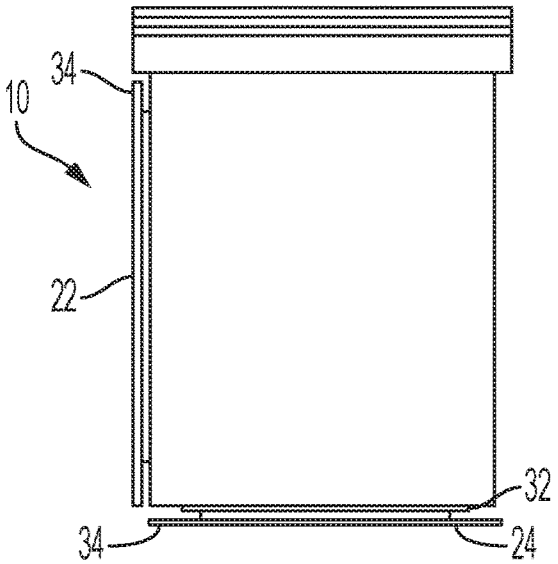
Figure 6:
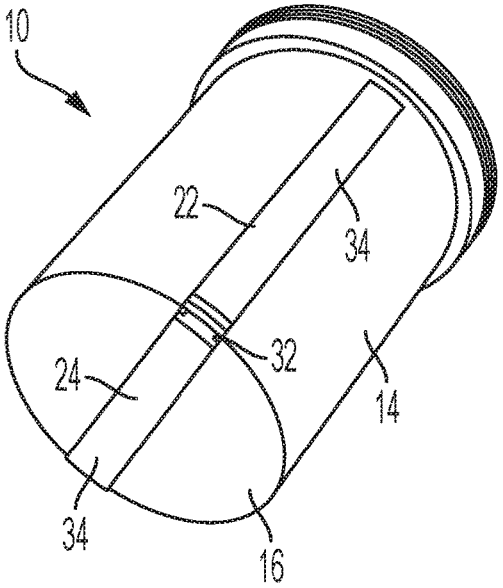
FIG. 6 is a bottom perspective view thereof.

As shown in FIGS. 4-6, the sidewall mating member 22 and distal mating member 24 are defined by protruding mating T-shaped flanges. The T-shaped flange 24 includes a radially outwardly extending base 32 having a first width and key member 34 having a second width, greater than the base 32 width, and which extends circumferentially outwardly therefrom so as to form a "T" configuration in profile (See FIG. 5B).

The sidewall mating member 22 and distal mating member 24 are thus configured to be received by an attachment, such as a supportive attachment, having an aperture or channel for receiving the key member 34 and base member 32. As shown, the provision of both mating members 22, 24 on the socket 10 enables the socket to be positioned either horizontally or vertically. Of course, only one may be provided without departing from the scope of the present invention.

Figure 7:
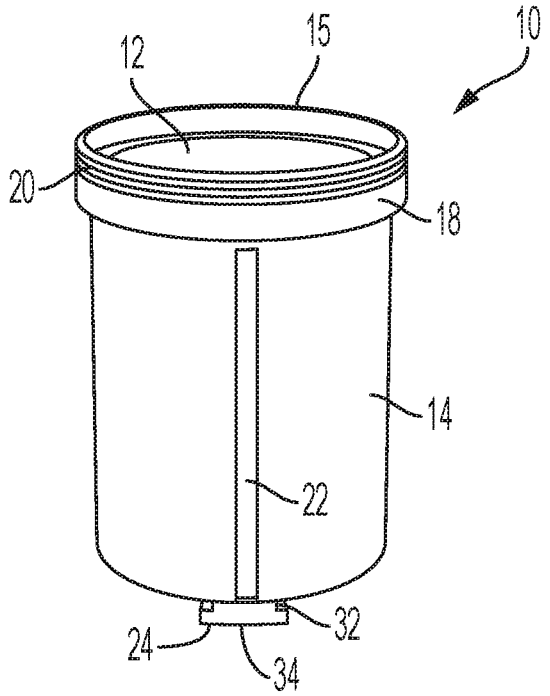
FIG. 7 is a perspective view of the socket according to another aspect of the present invention.
Figure 8A:
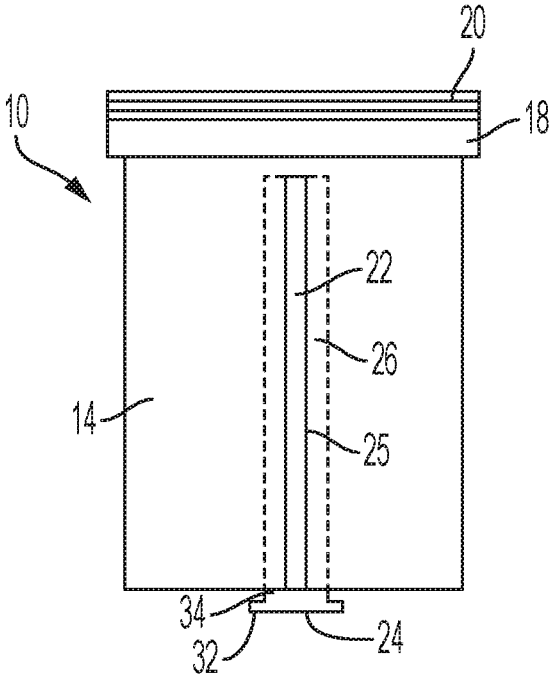
FIGS. 8A and 8B are side elevational, schematic views thereof.
Figure 8B:
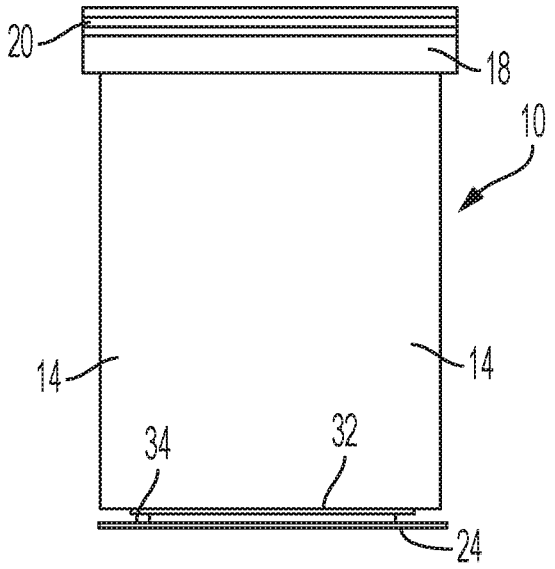
Figure 9:
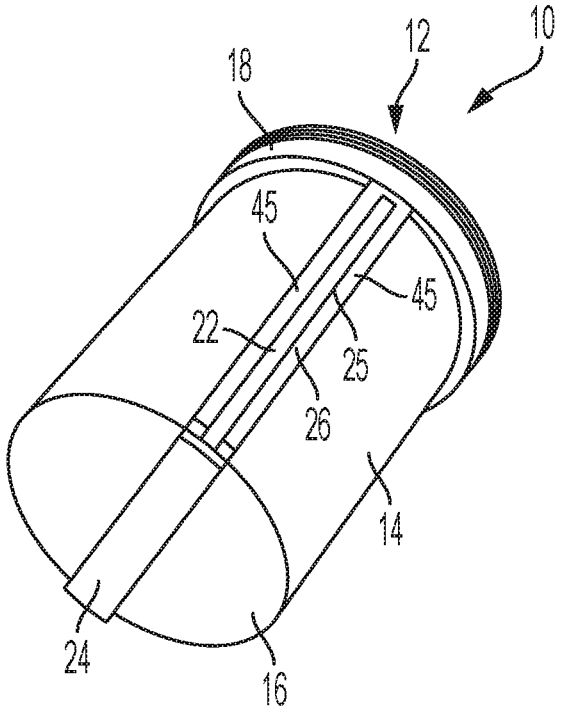
FIG. 9 is a bottom perspective view thereof.

FIGS. 7-9 depict a socket 10 including a recessed sidewall mating member 22 as shown and described with respect to FIGS. 1-3 and a protruding distal mating member 24 as shown and described with respect to FIGS. 4-6. Of course, the reverse is within the scope of the present invention—the socket 10 includes a protruding sidewall mating member 22 and a recessed distal mating member 24. The socket 10 according to these Figures provides versatility with regard to the direction of light illumination as well as the type of connection to an attachment.

FIG. 9 is provided by way of example consistent with that shown in FIG. 3. The sidewall mating member 22 may be flush with the sidewall 14 as shown in FIGS. 7-8 or may be defined by a pair of flanges 45 as shown in FIG. 9. The pair of flanges 45 define at least the exterior mating channel 25. The pair of flanges 45 may also define the interior mating channel 26 as shown.

As shown in each of the FIGS. 1-9, the socket includes the proximal flange 18 with the mating member 20, protruding or recessed sidewall mating members 22 and a protruding or recessed distal surface mating member 24. It is within the scope of the present invention, however, to provide the socket 10 with only one of these mating members 20, 22, 24 or any combination of two of these three mating members 20,22,24. Moreover, the recessed mating members 22,24 (sidewall or distal surface) may be provided in any combination: both protruding, both recessed, or one of each and each combination with or without a proximal mating member 20.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A light socket for a light bulb having an external configuration configured to cooperate with a light attachment and a socket support, said socket having a socket body comprising:

a generally cylindrical sidewall defining an open proximal end;

a distal end surface wherein said distal end surface and said generally cylindrical sidewall define a bulb receiving cavity;

a mating member on an outwardly facing surface of said socket body wherein said mating member is generally T-shaped and defines a first member having a first width and a second member having a second width greater than said first width, wherein said mating member extends a predetermined length along said socket body outwardly facing surface and is configured to permit slidable movement of the attachment along said predetermined length of mating member.

2. The light socket according to claim 1 wherein said distal end surface is coupled to said sidewall.

3. The light socket according to claim 1 wherein said sidewall further includes a proximal flange extending substantially circumferentially around said open proximal end wherein said flange includes a proximal mating member configured to cooperate with a lighting attachment.

4. The light socketing according to claim 3 wherein said proximal mating member is threaded.

5. The light socket according to claim 1 wherein said mating member extends longitudinally along said sidewall.

6. The light socket according to claim 5 wherein said mating member has an open distal end configured for receipt of the socket support.

7. The light socket according to claim 5 wherein said mating member is generally T-shaped wherein said first mating member is a base extending outwardly from said sidewall and said second mating member is a key member which extends substantially perpendicular to said first mating member on a radial end thereof.

8. The light socket according to claim 5 wherein said first mating member is an exterior channel having an open outwardly facing channel opening extending along said predetermined length and said second mating member is an interior channel extending radially inward from said first mating member and substantially along said predetermined length thereof.

9. The light socketing according to claim 8 wherein said mating member is substantially flush with said sidewall and said sidewall defines said exterior and interior channels.

10. The light socket according to claim 5 wherein said mating member includes a pair of flanges extending radially outwardly from said sidewall wherein said pair of flanges define said first mating member wherein said first mating member is an exterior channel having an open outwardly facing channel opening extending along said predetermined length.

11. The socket according to claim 10 wherein said pair of flanges define said second mating member wherein second mating member is an interior channel extending radially inward from said first mating member and substantially along said predetermined length thereof.

12. The light socket according to claim 5 wherein said mating member extends along said distal surface.

13. The light socket according to claim 12 wherein said mating member extends along said distal surface wherein said mating member along said sidewall and along said distal surface are co-linearly positioned.

14. The light socket according to claim 1 wherein said mating member extends along said distal end surface.

15. The light socket according to claim 14 wherein said mating member extends substantially diametrically across said distal end surface.

16. The light socket according to claim 14 wherein said mating member is generally T-shaped wherein said first mating member is a base extending outwardly from said sidewall and said second mating member is a key member which extends substantially perpendicular to said first mating member on a radial end thereof.

17. The light socketing according to claim 14 wherein said mating member has an open distal end.

18. The light socket according to claim 14 wherein said first mating member is an exterior channel having an open outwardly facing channel opening extending along said predetermined length and said second mating member is an interior channel extending radially inward from said first mating member and substantially along said predetermined length thereof.

19. The light socket according to claim 18 wherein said mating member is substantially flush with said distal end surface and distal end surface defines said exterior and interior channels.

20. The light socket according to claim 14 wherein said mating member includes a pair of flanges extending radially outwardly from said distal end surface wherein said pair of flanges defines said first mating member.

21. The socket according to claim 20 wherein said pair of flanges further defines said second mating member wherein second mating member is an interior channel extending radially inward from said first mating member and substantially along said predetermined length thereof.

* * * * *